US011629456B2

(12) United States Patent
Herath Mudiyanselage et al.

(10) Patent No.: US 11,629,456 B2
(45) Date of Patent: Apr. 18, 2023

(54) FUNCTIONAL FABRIC COATINGS FOR SYNTHETIC FABRICS

(71) Applicant: Paradise Textiles Ltd, Wuxi (CN)

(72) Inventors: Achala Herath Mudiyanselage, Wuxi (CN); Sunil Prakash, Wuxi (CN); Ashok Mahtani, Wuxi (CN)

(73) Assignee: Paradise Textiles Ltd, Wuxi (CN)

( * ) Notice: Subject to any disclaimer, the term of this patent is extended or adjusted under 35 U.S.C. 154(b) by 107 days.

(21) Appl. No.: 17/385,379

(22) Filed: Jul. 26, 2021

(65) Prior Publication Data

US 2022/0275572 A1 Sep. 1, 2022

(30) Foreign Application Priority Data

Feb. 26, 2021 (CN) ..... 202110213974.8

(51) Int. Cl.

| | |
|---|---|
| ***D06M 15/564*** | (2006.01) |
| ***D06M 11/46*** | (2006.01) |
| ***D06M 15/263*** | (2006.01) |
| ***D06M 15/507*** | (2006.01) |
| ***D06M 15/53*** | (2006.01) |

(52) U.S. Cl.

CPC ..... *D06M 15/564* (2013.01); *D06M 11/46* (2013.01); *D06M 15/263* (2013.01); *D06M 15/507* (2013.01); *D06M 15/53* (2013.01); *D06M 2200/00* (2013.01)

(58) Field of Classification Search

CPC .. D06M 15/507; D06M 15/53; D06M 15/564; D06M 2200/00; B32B 2255/02; B32B 2255/26; B32B 27/12; D10B 2501/00; D06N 3/14

See application file for complete search history.

(56) References Cited

U.S. PATENT DOCUMENTS 5,710,080 A * 1/1998 Pellegrini ..... B32B 27/36 442/373
2015/0374084 A1* 12/2015 Tsai ..... D06N 3/0063 427/389.9
2022/0074129 A1* 3/2022 Loyan ..... D06P 1/5221

FOREIGN PATENT DOCUMENTS

JP 2007092221 A * 4/2007

OTHER PUBLICATIONS

Espacenet translation of JP-2007092221-A. (Year: 2007).*

* cited by examiner

*Primary Examiner* — Jeremy R Pierce
*Assistant Examiner* — Christine X Nisula
(74) *Attorney, Agent, or Firm* — Myers Bigel, P.A.

(57) ABSTRACT

The present disclosure is directed to a kind of functional fabric coating that may be applied (or coated) on a synthetic fabric that can effectively alter the opacity (i.e., transparency, sheer proof, light shielding) and hydrophilicity (i.e., wicking, moisture management) of the finished fabric, without significantly affecting the synthetic fabric's physiochemical properties.

20 Claims, 5 Drawing Sheets
(4 of 5 Drawing Sheet(s) Filed in Color)

FUNCTIONAL FABRIC COATINGS FOR SYNTHETIC FABRICS

RELATED APPLICATION(S)

The present application claims priority to and the benefit of Chinese Patent Application No. 202110213974.8, filed Feb. 26, 2021, the disclosure of which is hereby incorporated herein in its entirety.

TECHNICAL FIELD

The invention relates to the field of fabric finishing (e.g., wet processing) in the textile sector mainly, and in particular, to a functional fabric coating for synthetic fabrics that can have an improved opacity and hydrophilicity on the finished fabric.

BACKGROUND

Clothing fabrics usually include different fibers primarily from natural, regenerated, and synthetic origins. All fabrics have a certain degree of opacity that is based on their inherent properties and structural properties (yarn and fabric). The color (dye and pigment present on the substrate) of the fabric also significantly alter the overall cumulative effect of a fabric's opacity. Among all the fabrics, thin and light-colored clothing fabrics are very popular because of their soft feel, comfortable wearing, simple appearance, natural beauty, and luster. These fabrics have the potential to add an element of elegance and sophistication to any garment or room (interior decoration) when they are made in a specific way with specific fiber composition.

However, light-colored thin and light clothing fabrics have the characteristics of high light transmittance, so single-layer clothing bears the risk of higher see-through effect, which has its own negative impacts on garments. When they are synthetic fabrics, they significantly affect the garment comfort properties too due to their inherent poor hydrophilicity.

Traditionally, these see-through or high sheer or low opacity fabrics are generally made into a multilayer structure or supported with lining fabrics. However, the multilayer structure or lining will affect elegance, softness, and the sophistication of these garments to a major extent. These will invariably affect the comfort properties of the garments too. Therefore, there may be a desire to provide an effective solution that alters the opacity and hydrophilicity characteristics of the fabric.

SUMMARY

Embodiments of the present invention are directed to a finished coated fabric with reduced see-through effect and more wicking (depending upon the intended applications) such that the wearer can comfortably use the fabrics for various functional garments. The coating thickness can vary as per need and yet it can provide its salient features with less increment on the fabric thickness and without significantly affecting drape, feel, and handle properties of the fabric or garment.

In order to achieve the above objective, the present invention proposes a finished (coated) synthetic fabric that possess enhanced characteristics on opacity and hydrophilicity. An aqueous advanced fabric-finishing recipe is used to coat the surface of the base fabric uniformly to realize these outcomes.

Further, according to embodiments of the present invention, the coated finished fabric has a coating thickness in the range from about 0.001 mm to about 3.0 mm. This coating, along with a base fabric, will give a completely matte look that enhances the look of the fabric or garment aesthetically to a greater extent. The matte look is intended here to control the light reflecting and scattering effect to achieve desired opacity as per the end use of the garment.

Further, according to embodiments of the present invention, the coated fabric is capable of having better opacity and hydrophilicity. In some embodiments, the base fabric has an outer surface and an inner surface, and this functional finish coating may be applied on the inner surface, outer surface, or both sides of the fabric, based on the intended application.

Further, according to embodiments of the present invention, the finished coated fabric may include a lining fabric layer on the inner or outer side of the base fabric.

Comparing with the existing technologies available, the beneficial effects of the present invention may include: by a layer of aqueous finishing chemical formula formed on the surface of the base fabric, the opacity and hydrophilicity are enhanced for better functionality without significantly changing the basic characteristics of the base fabric, and the problems existing in the multilayer structure or lining in the existing technologies may be solved.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION

Figure 1:
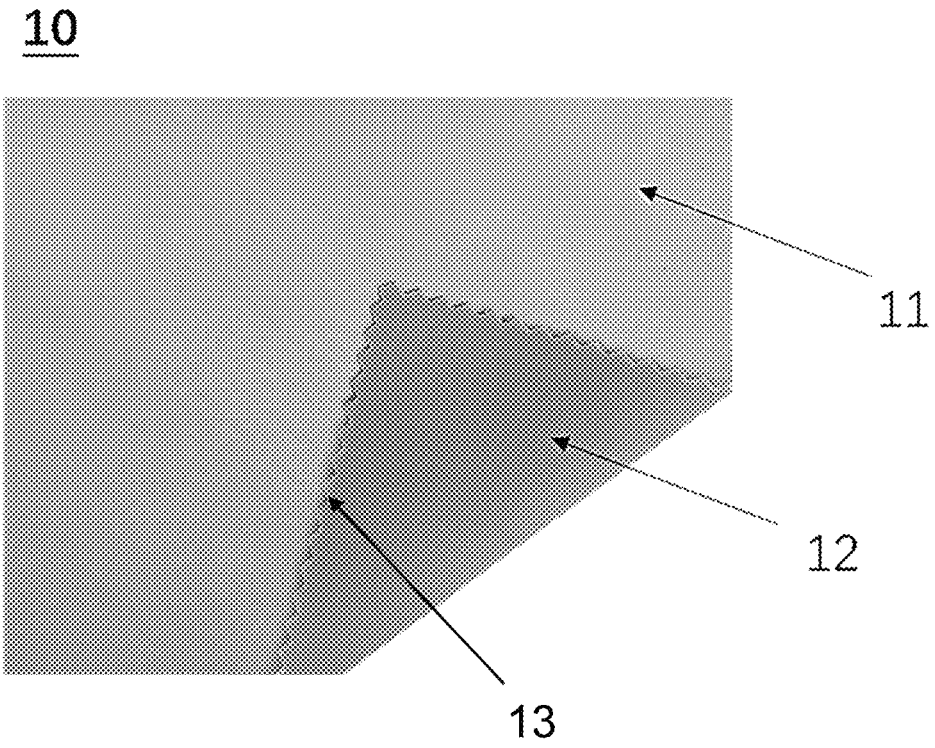
FIG. 1 is a schematic diagram of an exemplary coated (finished) fabric according to embodiments of the present application.
Figure 2A:
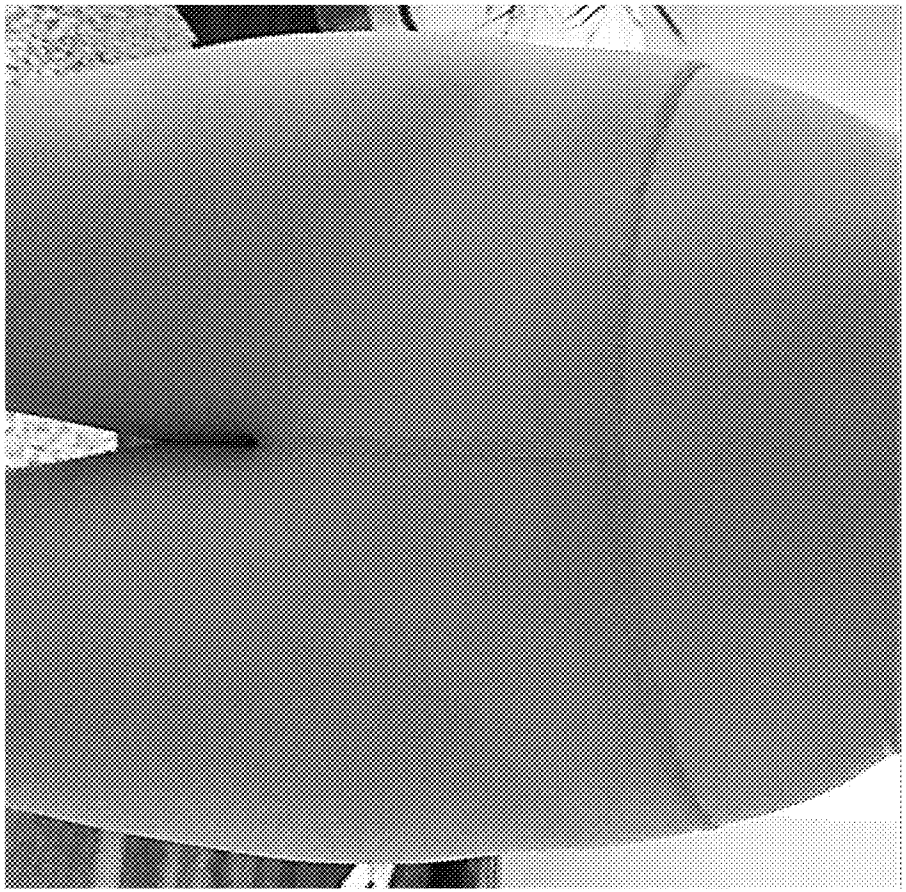
FIGS. 2A-2C are photographs of an exemplary garment without the functional fabric coating according to embodiments of the present application.
Figure 2B:
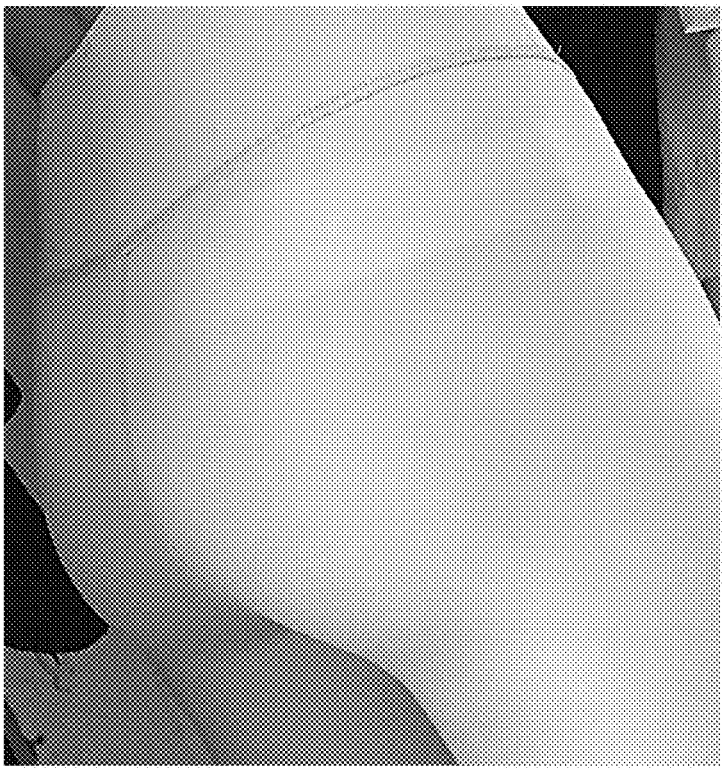
Figure 2C:
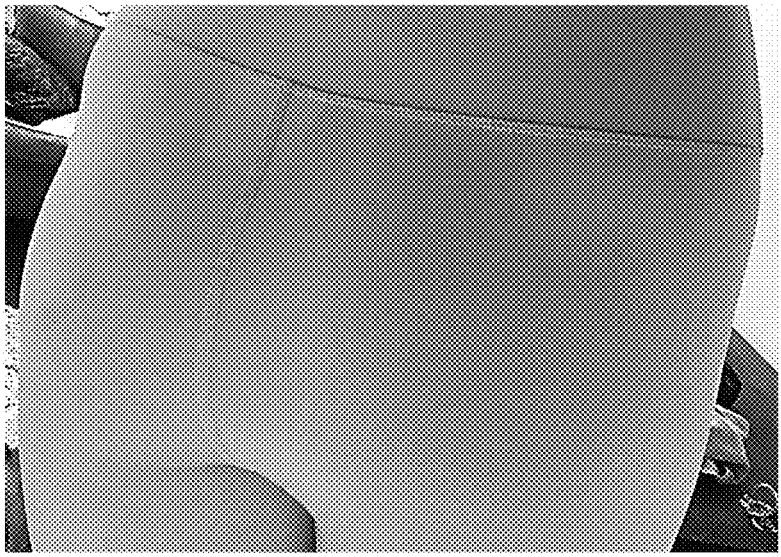

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

In the following, the finished coated fabric (with enhanced characteristics) of the present invention is described in more detail in conjunction with the figures, which shows the preferred execution example of the invention. It should be understood that the technical personnel in the field may modify the invention described here and still realize its beneficial effects. Therefore, the following description should be understood to be something widely known to the technical personnel in the field, but not as a limitation to the invention.

In the following paragraphs, the invention has described in more detail by way of example with the attached reference figures. According to the following description and claims, the advantages and features of the invention will be clearer. It should be noted that the figures all adopt a very simplified form and all use imprecise proportions, which are used to assist in explaining the purpose of the execution examples conveniently and clearly of the invention.

With reference to FIG. 1, in this exemplary embodiment, a finished coated fabric 10 having enhanced opacity and hydrophilicity according to embodiments of the present invention is illustrated. The finished coated fabric 10 includes a base fabric 11 and an advanced finishing coating 12 formed on the surface of the base fabric 11. The finished coating 12 is an aqueous advanced finishing chemical formula, which is used to alter the opacity of the base fabric 11 and also to increase the hydrophilicity or wicking properties of the fabric.

In some embodiments, in the finished (coated) fabric, the thickness of the coating 12 may range from 0.001 mm to 3.0 mm; and preferably, the thickness of the coating 12 is 0.001 mm, 0.002 mm, 0.005 mm, 0.008 mm, 0.02 mm, 0.05 mm or 0.08 mm, or any range therebetween. In some embodiments, the coating, along with a base fabric, may give the finished fabric a completely matte look that aesthetically enhances the look of the fabric or garment. The matte look is intended here to help control the light reflecting and scattering effect to achieve a desired opacity as per the end use of the garment.

Figure 3A:
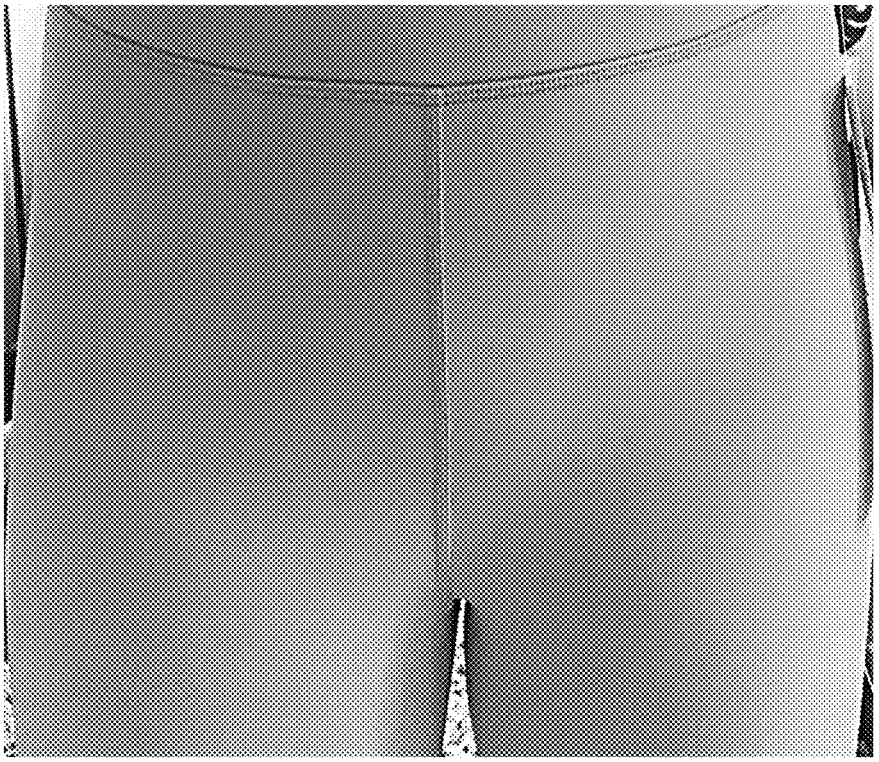
FIGS. 3A-3C are photographs of an exemplary garment with the functional fabric coating according to embodiments of the present invention.
Figure 3B:
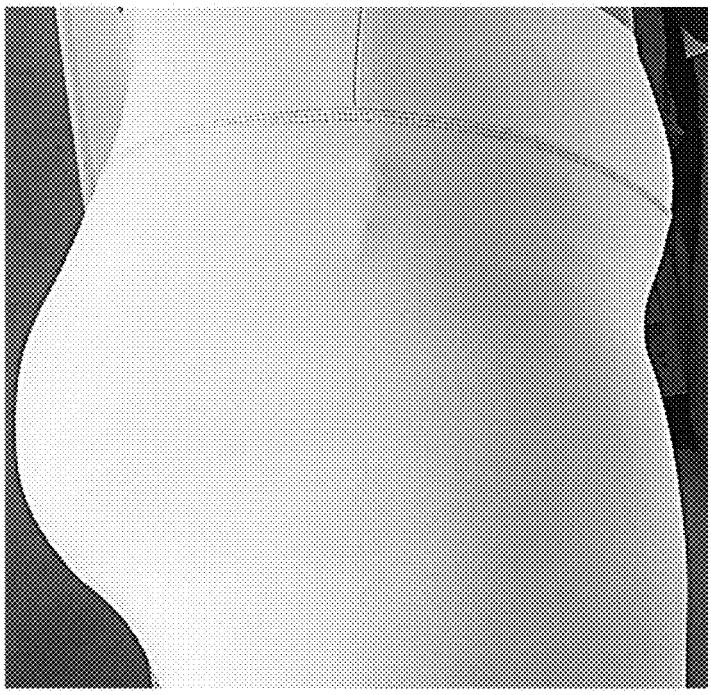
Figure 3C:
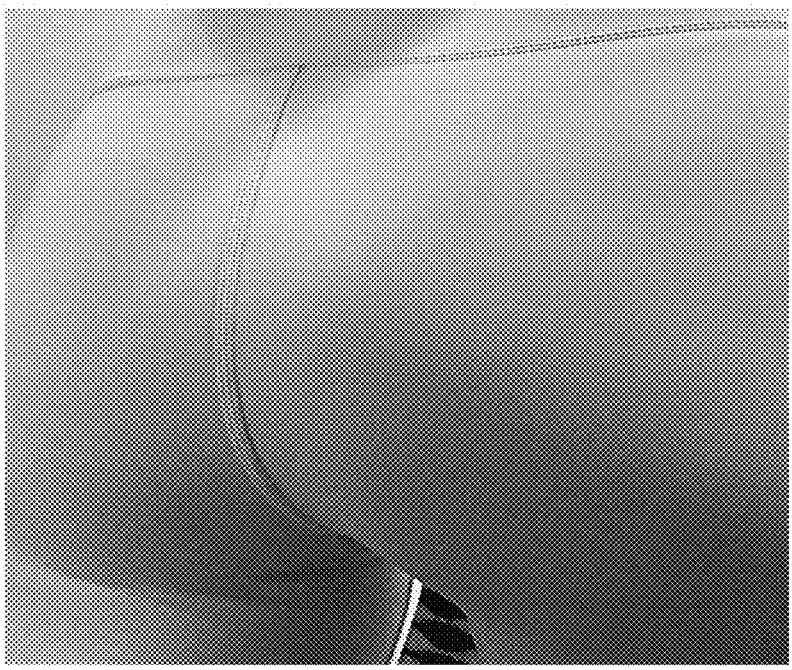

In some embodiments, the gloss of the functional coating 12 is very dim, so it can increase the opacity of the treated base fabric 11. Referring to FIGS. 2A-2C and FIGS. 3A-3C, FIGS. 2A-2C are photographs of an exemplary fabric without the functional coating 12 applied to the garment (e.g., leggings) and FIGS. 3A-3C are photographs of an exemplary fabric using a functional coating 12 according to embodiments of the present application applied to the garment (e.g., leggings). As shown in in the figures, the clothing without the functional coating can exhibit the innerwear beneath the garment (i.e., the innerwear can be seen through the garment) (FIGS. 2A-2C), whereas, the clothing using the functional coating fabric according to embodiments of the present invention has no see-through effect due to increased opacity (FIGS. 3A-3C). The comparison between the two garments (i.e., FIGS. 2A-2C and FIGS. 3A-3C) shows that the finished fabric having the functional coating according to embodiments of the present invention has no see—through effect, thereby providing a safer protective effect for the wearer.

Meanwhile, according to embodiments of the present invention, the functional coating 12 may also be aqueous, so it will not affect certain characteristics of the fabric, for example, moisture management and permeability. Accordingly, the chemical formula has good film-forming properties and high bonding strength for textiles, can give fabrics a soft and full feel, and improve fabric wear resistance, wrinkle resistance, resilience, permeability, and heat resistance.

In some embodiments of the present invention, the functional coating 12 is a type of coating based on chemical combination of aqueous polyurethane (PU) comprising the following components (A-F): (A) aqueous aliphatic polyurethane dispersion having components of one or more diisocyanates, aliphatic diisocyanates, polyamines, aminoalcohols, polyalcohols, hydrophilizing compound, polysiloxane, hydrazine, and a mixture of 5-chloro-2-methyl-2H-isothiazol-3-one and 2-methyl-2H-isothiazol-3-one; (B) aqueous polyether dispersion with 1,2-benzisothiazol-3 (2H)-one; (C) aqueous polyester dispersion with tristyrylphenol ethoxylates; (D) titanium dioxide rutile and acrylonitrile-butadiene-styrene; (E) diethylene glycol and carbon black; (F) aqueous polyacrylate dispersion with aliphatic hydrocarbons, isotridecanol ethoxylated and fatty acid polydiethanolamide and with water as the dispersion medium.

In some embodiments, the coating may be modified by crosslinking and has good storage stability, mechanical properties of the coating film, water resistance, solvent resistance and aging resistance, and its performance is similar to that of traditional solvent-based coatings.

This new generation aqueous polyurethane coatings may be compared with other solvent-based emulsions, namely, polyurethane emulsion and polyacrylic acid emulsion, and has the advantages of safety, non-combustibility, non-toxicity, and no pollution to the environment. Polyacrylic emulsion has the disadvantages of poor abrasion resistance, water resistance and chemical resistance. Polyurethane emulsion also has some shortcomings, such as poor stability, white thickening and gloss retention of the film, high solid content, and limited application range. PU and PA emulsions have complementary effects in nature. The aqueous polyurethane coating of the present invention exhibits the advantages of both: it has the characteristics of wear resistance, corrosion resistance and brightness, softness and elasticity, good water resistance and mechanical properties, and good weather resistance.

In addition, in some embodiments, in the finished coated fabric with enhanced opacity and hydrophilicity, the base fabric 11 may have an outer surface and an inner surface. In some embodiments, the functional coating layer 12 may be formed on the inner surface. In some embodiments, the functional coating layer 12 may be formed on the outer surface. In some embodiments, the functional coating layer 12 may be formed on both the inner surface and the outer surface of the base fabric 11. In some embodiments, the coated fabric 10 may further include a lining fabric layer 13 (FIG. 1). In some embodiments, the lining fabric layer 13 may be formed on the surface of the base fabric 11 or on the surface of the functional coating 12 to further reduce the see-through effect, if needed.

In summary, in the finished coated fabric with enhanced opacity and hydrophilicity according to embodiments of the present invention described herein, a functional coating is formed on the surface (inner or outer) of the base fabric, such that the see-through effect of the base fabric can be reduced without changing the treated fabric characteristics, and the problem of multilayer or liner structure in the existing technologies is solved.

An objective of the present invention is to apply an advanced chemical formula as a functional coating to all kinds of synthetic fabrics without affecting the inherent characteristics of the treated fabric, and only to enhance the opacity and hydrophilicity of the fabric itself. The fabrics with this functional coating applied can be used to make all kinds of clothing, including but not limited to pants or tops. In addition, the present invention may be used on other various textiles such as, home textiles, apparel, technical textiles, interior decorations, and upholstery.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claim is:

1. A functional fabric coating for a synthetic fabric, the coating comprising (a) aqueous aliphatic polyurethane dispersion having components of one or more diisocyanates, aliphatic diisocyanates, polyamines, aminoalcohols, polyalcohols, hydrophilizing compound, polysiloxane, hydrazine, and a mixture of 5-chloro-2-methyl-2H-isothiazol-3-one and 2-methyl-2H-isothiazol-3-one; (b) aqueous polyether dispersion with 1,2-benzisothiazol-3(2H)-one; (c) aqueous polyester dispersion with tristyrylphenol ethoxylates; (d) titanium dioxide rutile and acrylonitrile-butadiene-styrene; (e) diethylene glycol and carbon black; and (f) aqueous polyacrylate dispersion with aliphatic hydrocarbons, isotridecanol ethoxylated and fatty acid polydiethanolamide.

2. The functional fabric coating defined in claim 1, wherein when applied to the synthetic fabric to form a finished fabric, the coating alters the opacity and hydrophilicity characteristics of the finished fabric.

3. The functional fabric coating defined in claim 2, wherein the coating is applied to an inner surface of the fabric, an outer surface of the fabric, or both the inner surface and outer surface of the fabric.

4. The functional fabric coating defined in claim 3, wherein the coating on the inner and/or outer surface of the fabric has a thickness in the range of about 0.001 mm to about 3.0 mm.

5. The functional fabric coating defined in claim 2, wherein the finished fabric further comprises one or more lining fabric layers.

6. The functional fabric coating defined in claim 5, wherein the one or more lining fabric layers are formed on an inner surface of the finished fabric, an outer surface of the finished fabric, or both the inner surface and outer surface of the finished fabric.

7. The functional fabric coating defined in claim 2, wherein the finished fabric is used as a textile, a home textile, apparel, a technical textile, interior decorations, or upholstery.

8. A finished fabric, the finished fabric comprising:

a base fabric having an inner surface and an outer surface; and a functional fabric coating applied to the inner surface and/or outer surface of the base fabric, the coating comprising: (a) aqueous aliphatic polyurethane dispersion having components of one or more diisocyanates, aliphatic diisocyanates, polyamines, aminoalcohols, polyalcohols, hydrophilizing compound, polysiloxane, hydrazine, and a mixture of 5-chloro-2-methyl-2H-isothiazol-3-one and 2-methyl-2H-isothiazol-3-one; (b) aqueous polyether dispersion with 1,2-benzisothiazol-3(2H)-one; (c) aqueous polyester dispersion with tristyrylphenol ethoxylates; (d) titanium dioxide rutile and acrylonitrile-butadiene-styrene; (e) diethylene glycol and carbon black; and (f) aqueous polyacrylate dispersion with aliphatic hydrocarbons, isotridecanol ethoxylated and fatty acid polydiethanolamide, wherein the coating alters the opacity and hydrophilicity characteristics of the finished fabric.

9. The finished fabric defined in claim 8, wherein the base fabric comprises synthetic fibers.

10. The finished fabric defined in claim 8, wherein the coating on the inner and/or outer surface of the fabric has a thickness in the range of about 0.001 mm to about 3.0 mm.

11. The finished fabric defined in claim 8, wherein the base fabric comprises one or more lining fabric layers.

12. The finished fabric defined in claim 11, wherein the one or more lining fabric layers are formed on an inner surface of the base fabric, an outer surface of the base fabric, or both the inner surface and outer surface of the base fabric.

13. The finished fabric defined in claim 8, wherein the finished fabric is used as a textile, a home textile, apparel, a technical textile, interior decorations, or upholstery.

14. A finished fabric, the finished fabric comprising:

a base fabric comprising synthetic fibers, the fabric having a surface; and a functional fabric coating applied on the surface of the base fabric, the coating comprising (a) aqueous aliphatic polyurethane dispersion having components of one or more diisocyanates, aliphatic diisocyanates, polyamines, aminoalcohols, polyalcohols, hydrophilizing compound, polysiloxane, hydrazine, and a mixture of 5-chloro-2-methyl-2H-isothiazol-3-one and 2-methyl-2H-isothiazol-3-one; (b) aqueous polyether dispersion with 1,2-benzisothiazol-3(2H)-one; (c) aqueous polyester dispersion with tristyrylphenol ethoxylates; (d) titanium dioxide rutile and acrylonitrile-butadiene-styrene; (e) diethylene glycol and carbon black; and (f) aqueous polyacrylate dispersion with aliphatic hydrocarbons, isotridecanol ethoxylated and fatty acid polydiethanolamide, wherein the functional fabric coating alters the opacity and hydrophilicity characteristics of the base fabric.

15. The finished fabric described in claim 14, wherein functional fabric coating on the surface of the base fabric has a thickness in the range of about 0.001 mm to about 3.0 mm.

16. The finished fabric as described in claim 14, wherein the base fabric comprises an outer surface and an inner surface, and the functional fabric coating is applied on the inner surface, on the outer surface, or on both the inner and outer surface of the base fabric.

17. The finished fabric as described in claim 14, wherein the base fabric further comprises one or more layers of lining fabric.

18. The finished fabric defined in claim 17, wherein the one or more lining fabric layers are formed on an inner surface of the base fabric, an outer surface of the base fabric, or both the inner surface and outer surface of the base fabric.

19. The finished fabric as described in claim 14, wherein the finished fabric is used as a textile, a home textile, apparel, a technical textile, interior decorations, or upholstery.

20. The finished fabric as described in claim 14, wherein the finished fabric has a matte look.

* * * * *